US010464578B2

(12) United States Patent
Mishra et al.

(10) Patent No.: US 10,464,578 B2
(45) Date of Patent: Nov. 5, 2019

(54) WEIGHT SHIFTING MECHANISM FOR A POWERED LOCOMOTIVE BOGIE

(71) Applicant: Progress Rail Locomotive Inc., LaGrange, IL (US)

(72) Inventors: Saket Ashokkumar Mishra, Burr Ridge, IL (US); Xiaoying Ma, Chicago, IL (US); Kevin Lucas Kohler, Chicago, IL (US)

(73) Assignee: Progress Rail Locomotive Inc., LaGrange, IL (US)

( * ) Notice: Subject to any disclaimer, the term of this patent is extended or adjusted under 35 U.S.C. 154(b) by 368 days.

(21) Appl. No.: 15/350,929

(22) Filed: Nov. 14, 2016

(65) Prior Publication Data

US 2018/0134305 A1 May 17, 2018

(51) Int. Cl.

| | |
|---|---|
| ***B61C 15/14*** | (2006.01) |
| ***B61F 3/04*** | (2006.01) |
| ***B61C 15/04*** | (2006.01) |
| ***B61F 5/36*** | (2006.01) |
| ***B61C 3/00*** | (2006.01) |
| ***B61F 5/26*** | (2006.01) |
| ***B61F 5/16*** | (2006.01) |

(52) U.S. Cl.

CPC ..... *B61C 15/14* (2013.01); *B61C 3/00* (2013.01); *B61C 15/04* (2013.01); *B61F 3/04* (2013.01); *B61F 5/16* (2013.01); *B61F 5/26* (2013.01); *B61F 5/36* (2013.01)

(58) Field of Classification Search

CPC . B61C 15/04; B61C 15/14; B61F 5/36; B61F 3/04; B61F 5/16; B61F 5/26

USPC ..... 105/75

See application file for complete search history.

(56) References Cited

U.S. PATENT DOCUMENTS

| | | | | |
|---|---|---|---|---|
| 227,778 A | | 5/1880 | Henszey | |
| 262,163 A | | 8/1882 | Waterman | |
| 284,520 A | * | 9/1883 | Wetmore | B61C 15/04 105/75 |
| 307,404 A | | 10/1884 | Merrill | |
| 314,747 A | | 3/1885 | Stream | |
| 316,380 A | | 4/1885 | Merrill | |
| 323,283 A | | 7/1885 | Dees | |
| 352,005 A | * | 11/1886 | Richardson | B61C 15/04 105/75 |

(Continued)

FOREIGN PATENT DOCUMENTS

GB 1395848 A 5/1975

*Primary Examiner* — Zachary L Kuhfuss
(74) *Attorney, Agent, or Firm* — Miller, Matthias & Hull

(57) ABSTRACT

A weight shifting mechanism for a bogie frame is provided. The weight shifting mechanism may include an axle support pivotally coupled to the idler axle, a pusher link pivotally coupled to the axle support and forming a first fulcrum with the bogie frame, a support member pivotally coupled to the pusher link and the axle support, and an actuator mounted on the support member and actuatably coupled to the axle support via a live lever and a connector link. The live lever may form a second fulcrum with the support member and may be pivotally coupled to the connector link. The connector link may be pivotally coupled to the axle support. The actuator may selectively pivot the live lever about the second fulcrum to pivot the axle support about the idler axle and move the bogie frame relative to the idler axle.

20 Claims, 4 Drawing Sheets

(56) References Cited

U.S. PATENT DOCUMENTS 363,856 A * 5/1887 Selkirk ..... B61C 15/04 105/75
697,536 A * 4/1902 Player ..... B61C 15/04 105/75
744,398 A * 11/1903 Player ..... B61C 15/04 105/75
816,505 A * 3/1906 Sheldon ..... B61C 15/04 105/75
867,486 A * 10/1907 Dodd ..... B61C 15/04 105/75
3,520,005 A 7/1970 Downes
8,196,519 B2 * 6/2012 Kumar ..... B61F 3/06 105/194
8,313,111 B2 11/2012 Ahuja et al.
8,371,231 B2 * 2/2013 Kumar ..... B61C 15/04 105/73
8,371,232 B2 * 2/2013 Kumar ..... B61C 15/06 105/73
8,371,233 B2 * 2/2013 Kumar ..... B61C 15/04 105/73
8,424,888 B2 4/2013 Ahuja et al.
8,468,952 B2 6/2013 Worden et al.
8,584,596 B1 * 11/2013 Worden ..... B61F 5/36 105/157.1
8,677,909 B2 * 3/2014 Kumar ..... B61F 3/06 105/75
8,935,983 B2 * 1/2015 Kumar ..... B61C 15/04 105/194
2009/0031915 A1 * 2/2009 Kumar ..... B61C 15/04 105/34.1
2009/0031917 A1 * 2/2009 Kumar ..... B61C 15/04 105/35
2009/0095194 A1 * 4/2009 Kumar ..... B61C 15/04 105/73
2009/0095195 A1 * 4/2009 Kumar ..... B61C 15/04 105/96
2009/0095197 A1 * 4/2009 Kumar ..... B61C 15/04 105/96
2009/0099714 A1 * 4/2009 Kumar ..... B61C 15/04 701/19
2010/0175580 A1 7/2010 Gorski et al.
2010/0175581 A1 7/2010 Kumar et al.
2011/0079168 A1 4/2011 Kumar et al.
2011/0082606 A1 4/2011 Kumar et al.
2012/0049481 A1 * 3/2012 Ahuja ..... B61C 15/14 280/124.164
2012/0173056 A1 * 7/2012 Kumar ..... B61C 15/04 701/20
2013/0253739 A1 * 9/2013 Kumar ..... B61C 15/04 701/19

* cited by examiner

WEIGHT SHIFTING MECHANISM FOR A POWERED LOCOMOTIVE BOGIE

TECHNICAL FIELD

The present disclosure relates generally to powered locomotives, and more particularly, to traction control systems and methods for powered locomotives.

BACKGROUND

A conventional locomotive is generally supported on rails by an arrangement of suspension elements or bogies. While various arrangements are available, a typical locomotive is supported by two bogies, each having a plurality of wheelsets. In one known configuration, each bogie supports three wheelsets where each wheelset includes two wheels that are joined by an axle. The typical bogie also supports propulsion or drive mechanisms, such as an electric motor, to drive the wheelsets. Often, due to certain economic advantages, only one or two of the wheelsets of a bogie are driven by electric motors, while the remaining wheelsets support a portion of the load but are otherwise left to idle. While such configurations can provide economic benefits, these configurations also introduce concerns that have yet to be resolved.

While achieving optimal traction is a common concern for all locomotives, traction is a particular concern in locomotives using the bogie arrangements noted above, where only two out of three wheelsets are driven. In general, traction can be improved by increasing axle load on the driven wheels. However, regulatory requirements and other constraints place an upper limit on the amount of axle load that is allowed for a set of rails. Although it may be possible to overcome some of these limitations using active suspension solutions, currently available solutions tend to be impractical and/or inadequate.

One active solution is disclosed in U.S. Pat. No. 8,313,111 ("Ahuja"), which discloses a suspension system for locomotives with three wheelsets per bogie. In particular, the system in Ahuja shifts more weight onto the endmost wheelsets of each bogie by raising the center wheelset off of the rails. Although the solution may be effective in transferring weight to the drive wheels, Ahuja's configuration involves a complete redesign of the suspension and other substantial modifications to the conventional bogie. Moreover, Ahuja's solution may be costly to implement and not readily retrofittable to existing bogies and suspension components. Furthermore, Ahuja is only applicable to bogie configurations that have center-mounted idler wheelsets and endmost driven wheelsets, which are relatively less common among conventional bogie arrangements.

In view of the foregoing disadvantages associated with conventional locomotives, a need exists for a solution that is not only applicable to more commonly used bogie configurations, but also simple and cost-efficient enough to implement or retrofit. There is also a need for a system that can substantially improve traction or adhesion without exceeding regulatory constraints and without adversely affecting the overall performance of the locomotive. Furthermore, there is a need for an active system that can actively adjust axle load and traction according to changing operating conditions. The present disclosure is directed at addressing one or more of the deficiencies and disadvantages set forth above. However, it should be appreciated that the solution of any particular problem is not a limitation on the scope of this disclosure or of the attached claims except to the extent expressly noted.

SUMMARY OF THE DISCLOSURE

In one aspect of the present disclosure, a weight shifting mechanism for a bogie frame supporting at least one idler axle and one or more driven axles is provided. The weight shifting mechanism may include an axle support pivotally coupled to the idler axle, a pusher link pivotally coupled to the axle support and forming a first fulcrum with the bogie frame, a support member pivotally coupled to the pusher link and the axle support, and an actuator mounted on the support member and actuatably coupled to the axle support via a live lever and a connector link. The live lever may form a second fulcrum with the support member and may be pivotally coupled to the connector link. The connector link may be pivotally coupled to the axle support. The actuator may selectively pivot the live lever about the second fulcrum in a manner configured to pivot the axle support about the idler axle and move the bogie frame relative to the idler axle.

In another aspect of the present disclosure, a weight shifting system for a bogie frame of a locomotive supporting at least one idler axle and one or more driven axles is provided. The weight shifting system may include a weight shifting mechanism movably coupled between the idler axle and the bogie frame, an actuator operatively coupled to the weight shifting mechanism, and a controller operatively coupled to the actuator. The actuator may be configured to selectively engage the weight shifting mechanism to move the bogie frame relative to the idler axle. The controller may be configured to activate a traction assist command based on one or more operating conditions of the locomotive, and selectively enable the actuator when the traction assist mode is active.

In yet another aspect of the present disclosure, a method of shifting weight on a bogie frame of a locomotive supporting at least one idler axle and one or more driven axles is provided. The method may include providing a weight shifting mechanism movably coupled between the idler axle and the bogie frame, providing an actuator operatively coupled to the weight shifting mechanism and configured to selectively engage the weight shifting mechanism to move the bogie frame relative to the idler axle, monitoring one or more operating conditions of the locomotive, activating a traction assist mode based on the operating conditions, and selectively enabling the actuator when the traction assist mode is active.

These and other aspects and features will be more readily understood when reading the following detailed description in conjunction with the accompanying drawings.

While the following detailed description is given with respect to certain illustrative embodiments, it is to be understood that such embodiments are not to be construed as limiting, but rather the present disclosure is entitled to a scope of protection consistent with all embodiments, modifications, alternative constructions, and equivalents thereto.

DETAILED DESCRIPTION

Figure 1:
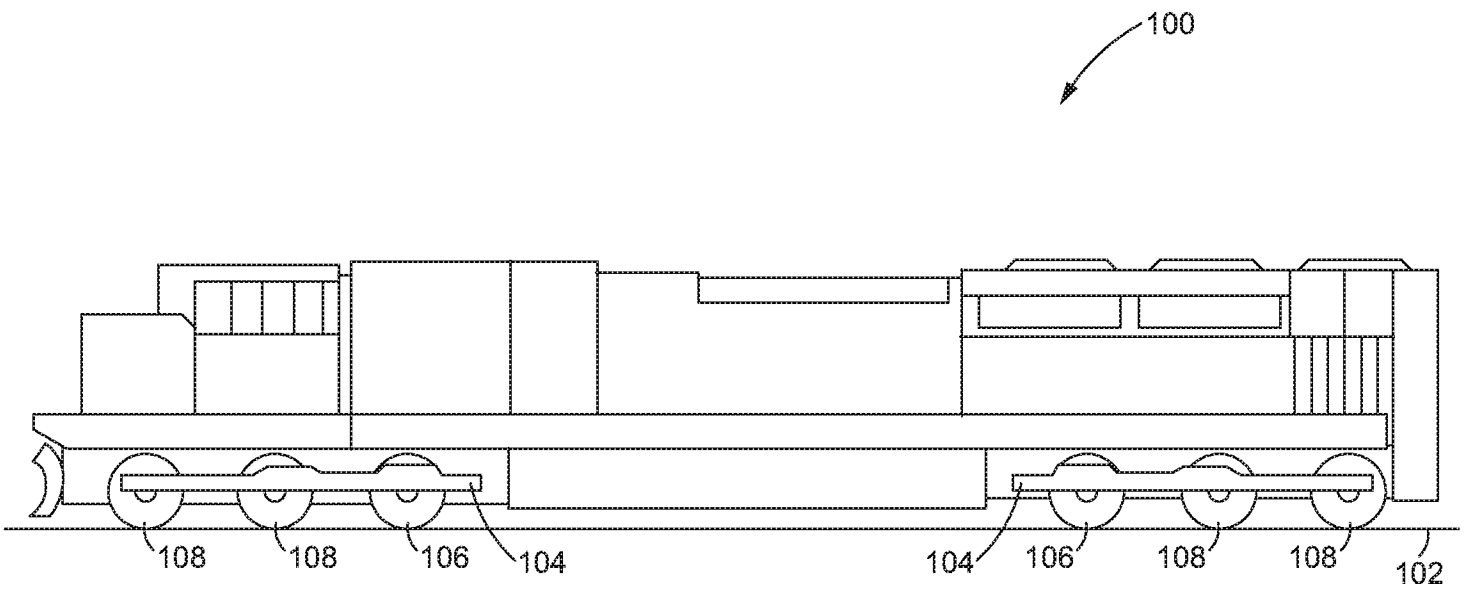
FIG. 1 is a side view of a powered locomotive being supported by bogies having driven wheelsets and at least one idler wheelset.

Referring to FIG. 1, one exemplary locomotive 100, which may incorporate the weight shifting systems and methods of the present disclosure, is provided. The locomotive 100 may represent any rail vehicle that is powered or driven by propulsion devices, such as electric traction motors, or the like. Furthermore, any vehicle powered by traction motors or other propulsion devices with suspension elements similarly arranged to those of the locomotive 100 shown in FIG. 1 may also incorporate the weight shifting systems and methods of the present disclosure. In the particular embodiment of FIG. 1, the locomotive 100 is supported on rails 102 by two bogie frames 104, where each bogie frame 104 may include one idler wheelset 106 and two driven wheelsets 108, and where the idler wheelsets 106 are positioned proximate to the center of the locomotive 100. The locomotive 100 may alternatively employ other arrangements of bogie frames 104 and wheelsets 106, 108 than shown in FIG. 1. For instance, the locomotive 100 may employ fewer or more bogie frames 104 than shown, or fewer or more driven wheelsets 108 than shown, so long as the locomotive 100 employs a bogie frame 104 with at least one idler wheelset 106.

Figure 2:
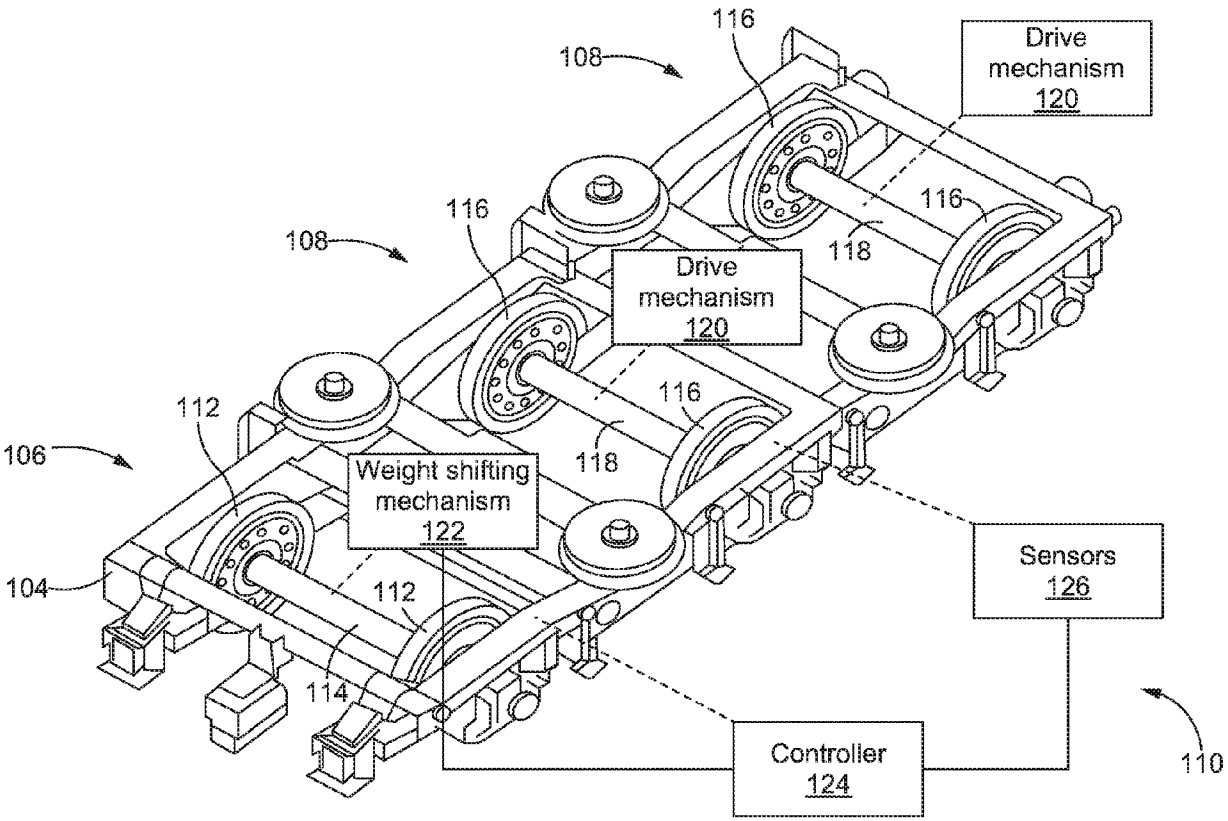
FIG. 2 is a diagrammatic view of one exemplary embodiment of a weight shifting system of the present disclosure as implemented on a bogie.

Turning to FIG. 2, one exemplary embodiment of a weight shifting system 110 that may be used with a bogie frame 104 is diagrammatically provided. As shown, the bogie frame 104 may include at least one idler wheelset 106 and two driven wheelsets 108. More specifically, each idler wheelset 106 may include two idler wheels 112 joined by an idler axle 114, and each driven wheelset 108 may include two driven wheels 116 joined by a driven axle 118. Furthermore, the driven axles 118 may be driven by one or more drive mechanisms 120, such as an electric traction motor, or the like. As shown, the weight shifting system 110 may be incorporated into the bogie frame 104 and include a weight shifting mechanism 122 that is coupled to the idler axle 114. Moreover, the weight shifting mechanism 122 may be incorporated into each bogie frame 104 of the given locomotive 100. The weight shifting system 110 may also include a controller 124 and one or more sensors 126, which may be disposed on the bogie frame 104 or otherwise located on the locomotive 100, and configured to monitor one or more operating conditions of the locomotive 100, such as motor speed, wheel speed, target travel speed, actual travel speed, ambient temperature, rail temperature, wheel temperature, load weight, wheel slip, and the like.

Figure 3:
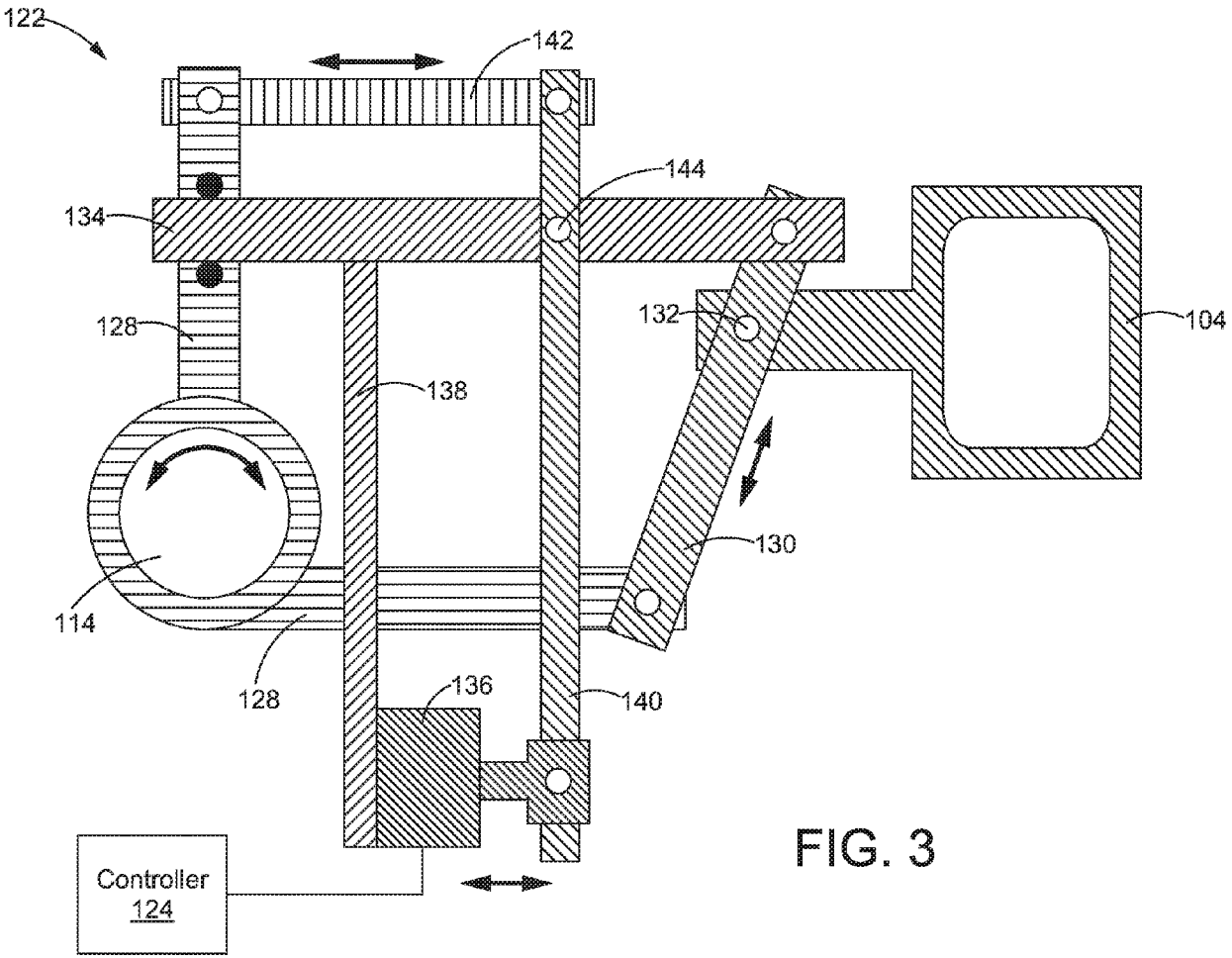
FIG. 3 is a schematic view of one exemplary embodiment of a weight shifting mechanism of the present disclosure.

Turning now to FIG. 3, one exemplary embodiment of a weight shifting mechanism 122 that maybe coupled to the idler axle 114 is provided. As shown, the weight shifting mechanism 122 may include an axle support 128 that is pivotally coupled to the idler axle 114. For instance, the axle support 128 may be rotatably supported on the idler axle 114 in a manner configured to adequately support the weight shifting mechanism 122 without significantly influencing the ability of the idler axle 114 to freely rotate. The weight shifting mechanism 122 may further include a pusher link 130 that is pivotally coupled to the axle support 128 and configured to form a first fulcrum 132 with the bogie frame 104, and a support member 134 that is pivotally coupled to both the pusher link 130 and the axle support 128. The weight shifting mechanism 122 may also include an actuator 136, such as a pneumatic or air cylinder, a hydraulic cylinder, or any other device that is electrically actuatable and operatively couples the weight shifting mechanism 122 to the bogie frame 104.

In general, the weight or load typically supported by the bogie frame 104 of FIG. 3 may be evenly distributed across each of the idler wheels 112 and the driven wheels 116. The weight shifting system 110 serves to shift some of the weight or load supported by each bogie frame 104 away from the idler axle 114 and onto the driven axles 118 to improve traction. More specifically, the actuator 136 is configured to selectively engage the weight shifting mechanism 122 when additional traction is desired, and the weight shifting mechanism 122 is configured to mechanically move the bogie frame 104 relative to the idler axle 114 when engaged by the actuator 136. As shown in FIG. 3, for example, the actuator 136 may be mounted on the support member 134, such as via an actuator support 138, and actuatably coupled to the axle support 128, such as via a live lever 140 and a connector link 142. The actuator support 138 may be sized and configured to sufficiently support the weight of the actuator 136, as well as provide adequate leverage for the actuator 136. The live lever 140 may form a second fulcrum 144 with the support member 134, and the connector link 142 may pivotally couple the live lever 140 to the axle support 128.

According to the arrangement shown in FIG. 3, the actuator 136 may be actuated to pivot the live lever 140 about the second fulcrum 144 in a manner configured to pivot the axle support 128 about the idler axle 114 and move the bogie frame 104 relative to the idler axle 114. Moreover, by pushing or moving the bogie frame 104 relative to the idler axle 114, the actuator 136 may be able to at least temporarily shift some of the supported load toward the driven axles 118, and thereby increase traction between the driven wheels 116 and the rails 102. Furthermore, the actuator 136 may be configured to selectively engage the weight shifting mechanism 122 when additional traction is desired, but otherwise allow the supported load to settle substantially evenly across the bogie frame 104. Still further, the force applied by the actuator 136 may be selected from discrete predetermined values, or alternatively, continuously variable depending on the operating conditions of the locomotive 100 or other relevant factors. While the embodiments depict only one possible weight shifting arrangement, it will be understood that other arrangements may be used in conjunction with the bogie configuration shown to provide comparable results.

Still referring to FIG. 3, the controller 124 may be separately provided or at least partially integrated within an engine management or control unit associated with the locomotive 100, and configured to electrically communicate with the one or more sensors 126. For example, the controller 124 may be implemented using one or more of a processor, a microprocessor, a microcontroller, an engine control module (ECM), an engine control unit (ECU), and any other suitable device for communicating with any one or more of the sensors 126, the actuator 136, and the like. Moreover, the controller 124 may be programmed or configured to operate according to predetermined algorithms or sets of logic instructions designed to manage control of the weight shifting system 110 or the actuator 136 thereof. For instance, the controller 124 may be configured to receive one or more sensor signals output by the sensors 126, monitor the sensor signals for various operating conditions of the locomotive 100, and electrically enable the actuator 136 if the operating conditions identify a need for a traction assist mode of operation.

INDUSTRIAL APPLICABILITY

In general, the present disclosure finds utility in various applications associated with locomotives or other rail vehicles that may be powered or driven by propulsion devices, such as electric traction motors, or the like. The present disclosure is also applicable to any other vehicle that may be powered by propulsion devices and provided with suspension similar to those of rail vehicles. Moreover, the present disclosure is applicable to vehicles which may employ one or more bogie frames and multiple wheelsets, where at least one of the wheelsets is an idler wheelset. The present disclosure provides a simplified solution that can actively shift weight on a bogie frame away from idler wheels and toward driven wheels according to vehicle operating conditions to increase traction at the driven wheels. Furthermore, the present disclosure is able to actively adjust the amount of traction at the driven wheels based on changes in operating conditions and according to predefined limits to ensure compliance with rail regulations.

Figure 4:
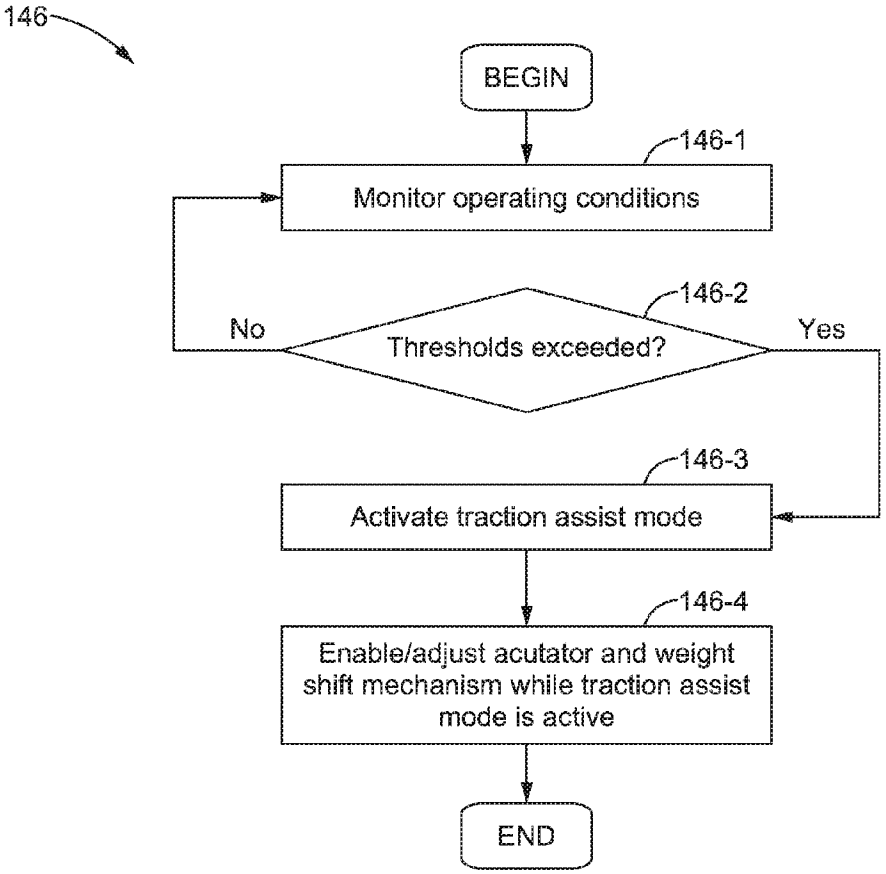
FIG. 4 is a flow diagram of one exemplary algorithm or method of shifting a weight of a bogie of a powered locomotive.

Turning to FIG. 4, one exemplary algorithm or method 146 of shifting weight on a bogie frame 104 of a locomotive 100 is provided. In particular, the method 146 may be implemented in the form of one or more algorithms, instructions, logic operations, or the like, and the individual processes thereof may be performed or initiated via the controller 124. As shown in block 146-1, the method 146 may initially monitor one or more operating conditions of the locomotive 100. In particular, the method 146 may communicate with one or more sensors 126 associated with the locomotive 100 to receive sensor signals that are indicative of operating conditions relevant to determining whether a traction assist mode of operation is required. For example, the method 146 in block 146-1 may monitor any one or more of motor speed, wheel speed, target travel speed, actual travel speed, ambient temperature, rail temperature, wheel temperature, load weight, wheel slip, and the like.

As shown in block 146-2 of FIG. 4, the method 146 may compare the operating conditions to predefined thresholds to determine whether a traction assist mode is desired. In one example, the method 146 may monitor for conditions where the actual travel speed of the locomotive 100 falls below a predefined upper speed threshold, and conditions where the wheel slip between the driven wheels 116 and the rails 102 exceeds a predefined lower slip threshold. More specifically, the method 146 may determine whether the actual travel speed falls below approximately 10 miles per hour, and whether the wheel slip exceeds approximately 1.5% of ideal conditions. If any of the operating conditions remains within acceptable limits in block 146-2, the method 146 may return to block 146-1 for instance, and continue monitoring for low traction conditions. If, however, the operating conditions satisfy all corresponding thresholds, the method 146 in block 146-3 may activate a traction assist mode.

Once traction assist mode has been activated, the method 146 in block 146-4 of FIG. 4 may shift the weight or load supported by the bogie frame 104 to improve traction. More specifically, as discussed with respect to the weight shifting mechanism 122 of FIG. 3 for example, the method 146 may cause the actuator 136 to tilt the bogie frame 104 and shift the supported load away from the idler wheels 112 and toward the driven wheels 116, so as to increase adhesion and traction between the driven wheels 116 and the rails 102. Furthermore, the method 146 may also active adjust control of the actuator 136, and thereby adjust the amount of weight that is shifted as well as the amount of load at the driven wheels 116. Still further, the method 146 may maintain periodic or continuous control of the actuator 136 and the weight shifting mechanism 122 until the traction assist mode is deactivated and/or until the operating conditions indicate that the traction assist mode is no longer needed.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A weight shifting mechanism for a bogie frame supporting at least one idler axle and one or more driven axles, the weight shifting mechanism comprising:

an axle support pivotally coupled to the idler axle;

a pusher link pivotally coupled to the axle support and forming a first fulcrum with the bogie frame;

a support member pivotally coupled to the pusher link and the axle support; and an actuator mounted on the support member and actuatably coupled to the axle support via a live lever and a connector link, the live lever forming a second fulcrum with the support member and being pivotally coupled to the connector link, the connector link being pivotally coupled to the axle support, the actuator selectively pivoting the live lever about the second fulcrum in a manner configured to pivot the axle support about the idler axle and move the bogie frame relative to the idler axle.

2. The weight shifting mechanism of claim 1, wherein the actuator is configured to selectively push the live lever relative to the idler axle, which in turn pushes the connector link toward the idler axle, pivots the axle support, and pushes the pusher link and the bogie frame relative to the idler axle.

3. The weight shifting mechanism of claim 2, wherein moving the bogie frame relative to the idler axle tips the bogie frame and shifts a supported load at least partially away from the idler axle and toward the driven axles to increase traction.

4. The weight shifting mechanism of claim 1, wherein the actuator is electrically actuatable between a disabled state and an enabled state, the actuator configured to maintain a substantially even distribution of a supported load over the idler axle and the driven axles in the disabled state, and configured to shift the supported load toward the driven axles and away from the idler axle in the enabled state.

5. The weight shifting mechanism of claim 4, wherein the actuator is automatically enabled when operating conditions demand increased traction and automatically disabled otherwise.

6. The weight shifting mechanism of claim 1, wherein the actuator is configured to selectively shift a supported load away from the idler axle and toward the driven axles based on operating conditions.

7. The weight shifting mechanism of claim 6, wherein the actuator is configured to adjust an amount of the supported load that is shifted as a function of one or more of motor speed, wheel speed, target travel speed, actual travel speed, ambient temperature, rail temperature, wheel temperature, load weight, and wheel slip.

8. The weight shifting mechanism of claim 1, wherein the actuator includes one of a pneumatic cylinder and a hydraulic cylinder.

9. A weight shifting system for a bogie frame of a locomotive supporting at least one idler axle and one or more driven axles, the weight shifting system comprising:

a weight shifting mechanism movably coupled between the idler axle and the bogie frame, including:

an axle support pivotally coupled to the idler axle;

a pusher link pivotally coupled to the axle support and forming a first fulcrum with the bogie frame; and a support member pivotally coupled to the pusher link and the axle support;

an actuator mounted on the support member and actuatably coupled to the axle support via a live lever and a connector link, the live lever forming a second fulcrum with the support member and being pivotally coupled to the connector link, the connector link being pivotally coupled to the axle support, the actuator selectively pivoting the live lever about the second fulcrum in a manner configured to pivot the axle support about the idler axle and move the bogie frame relative to the idler axle; and a controller operatively coupled to the actuator and configured to activate a traction assist command based on one or more operating conditions of the locomotive, and selectively enable the actuator when the traction assist mode is active.

10. The weight shifting system of claim 9, wherein the actuator is configured to selectively move the bogie frame relative to the idler axle when enabled so as to tip the bogie frame and shift a supported load at least partially away from the idler axle and toward the driven axles to increase traction.

11. The weight shifting system of claim 10, wherein the controller is configured to adjust an amount of the supported load that is shifted as a function of the operating conditions, the operating conditions including one or more of motor speed, wheel speed, target travel speed, actual travel speed, ambient temperature, rail temperature, wheel temperature, load weight, and wheel slip.

12. The weight shifting system of claim 9, wherein the controller is configured to automatically enable the actuator when the traction assist mode is active and automatically disable the actuator otherwise.

13. The weight shifting system of claim 9, wherein the controller is in communication with one or more sensors of the locomotive, the controller configured to receive one or more signals from the sensors indicative of the operating conditions of the locomotive, and monitor the operating conditions in order to activate the traction assist mode.

14. The weight shifting system of claim 13, wherein the controller activates the traction assist mode when actual travel speed of the locomotive falls below a predefined speed threshold and when wheel slip of the locomotive exceeds a predefined slip threshold.

15. The weight shifting system of claim 9, wherein the actuator includes one of a pneumatic cylinder and a hydraulic cylinder.

16. A method of shifting weight on a bogie frame of a locomotive supporting at least one idler axle and one or more driven axles, the method comprising:

providing a weight shifting mechanism movably coupled between the idler axle and the bogie frame including:

an axle support pivotally coupled to the idler axle;

a pusher link pivotally coupled to the axle support and forming a first fulcrum with the bogie frame; and a support member pivotally coupled to the pusher link and the axle support;

providing an actuator mounted on the support member and actuatably coupled to the axle support via a live lever and a connector link, the live lever forming a second fulcrum with the support member and being pivotally coupled to the connector link, the connector link being pivotally coupled to the axle support, the actuator selectively pivoting the live lever about the second fulcrum in a manner configured to pivot the axle support about the idler axle and move the bogie frame away from the idler axle;

monitoring one or more operating conditions of the locomotive;

activating a traction assist mode based on the operating conditions; and selectively enabling the actuator when the traction assist mode is active.

17. The method of claim 16, wherein the actuator is configured to selectively push the bogie frame relative to the idler axle when enabled so as to tip the bogie frame and shift a supported load at least partially away from the idler axle and toward the driven axles to increase traction.

18. The method of claim 17, wherein an amount of the supported load that is shifted is adjusted as a function of the operating conditions, the operating conditions including one or more of motor speed, wheel speed, target travel speed, actual travel speed, ambient temperature, rail temperature, wheel temperature, load weight, and wheel slip.

19. The method of claim 16, wherein the operating conditions are monitored based on one or more signals received from one or more sensors indicative of the operating conditions of the locomotive.

20. The method of claim 16, wherein the traction assist mode is activated when actual travel speed of the locomotive falls below a predefined speed threshold and when wheel slip of the locomotive exceeds a predefined slip threshold.

* * * * *